US007501761B2

(12) United States Patent
Kim

(10) Patent No.: US 7,501,761 B2
(45) Date of Patent: Mar. 10, 2009

(54) PLASMA DISPLAY PANEL AND METHOD FOR MAKING A PLASMA DISPLAY PANEL

(75) Inventor: Ki-Dong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 305 days.

(21) Appl. No.: 11/134,748

(22) Filed: May 19, 2005

(65) Prior Publication Data

US 2005/0264212 A1 Dec. 1, 2005

(30) Foreign Application Priority Data

May 25, 2004 (KR) ..... 10-2004-0037269

(51) Int. Cl.
*H01J 17/49* (2006.01)

(52) U.S. Cl. ..... 313/586; 313/582

(58) Field of Classification Search ..... 313/582, 313/584, 586

See application file for complete search history.

(56) References Cited

FOREIGN PATENT DOCUMENTS

| | | |
|---|---|---|
| JP | 9-15-85945 | 7/1997 |
| JP | 9-295894 | 11/1997 |
| JP | 11-3665 | 1/1999 |
| JP | 11-312469 | 11/1999 |
| JP | 2002-33053 | 1/2002 |
| JP | 2002-69617 | 3/2002 |

OTHER PUBLICATIONS

Patent Abstracts of Japan, Publication No. 09-185945, dated Jul. 15, 1997, in the name of Masaaki Asano.
Patent Abstract of Japan, Publication No. 09-295894, Published Nov. 18, 1997, in the name of Furuya Eiji.
Patent Abstract of Japan, Publication No. 11-003665, Published Jan. 6, 1999, in the name of Aoki Masaki, et al.

*Primary Examiner*—Vip Patel
(74) *Attorney, Agent, or Firm*—Christie, Parker & Hale, LLP

(57) ABSTRACT

A plasma display panel comprising first and second substrates positioned substantially parallel to each other, facing each other and separated from each other by a predetermined distance is disclosed. A plurality of address electrodes are formed on the first substrate. A first dielectric layer covers the address electrodes on the first substrate. A plurality of barrier ribs having predetermined heights are mounted on the first dielectric layer, creating discharge spaces between the first and second substrates. Phosphor layers are formed within the discharge spaces. A plurality of discharge sustain electrodes are formed on the second substrate and are positioned perpendicular to the address electrodes on the first substrate. A second dielectric layer is formed on the second substrate covering the discharge sustain electrodes. A MgO protection layer having a surface roughness (Rms) ranging from about 60 to about 250 Å covers the second dielectric layer.

7 Claims, 11 Drawing Sheets
(6 of 11 Drawing Sheet(s) Filed in Color)

| Region | Rp-v | Rms rough | Ave rough | Median Ht | Mean Ht |
|---|---|---|---|---|---|
| [ Å ] | 617 Å | 88.0 Å | 70.1 Å | 273 Å | 280 Å |

| Region | Rp-v | Rms rough | Ave rough | Median Ht | Mean Ht |
|---|---|---|---|---|---|
| [A] | 0.160 µm | 185 Å | 141 Å | 750 Å | 767 Å |

| Region | Rp-v | Rms rough | Ave rough | Median Ht | Mean Ht |
|---|---|---|---|---|---|
| [A] | 0.142 µm | 186 Å | 150 Å | 723 Å | 729 Å |

PLASMA DISPLAY PANEL AND METHOD FOR MAKING A PLASMA DISPLAY PANEL

CROSS-REFERENCE TO RELATED APPLICATION

This application claims priority to and the benefit of Korean Patent Application No. 10-2004-0037269 filed on May 25, 2004 in the Korean Intellectual Property Office, the entire content of which is incorporated herein by reference.

FIELD OF THE INVENTION

The present invention relates to a plasma display panel, and more particularly, to a plasma display panel comprising a MgO protection layer capable of improving electron emission by controlling surface roughness and increasing surface area.

BACKGROUND OF THE INVENTION

Generally, plasma display panels ("PDP"s) are display devices in which ultraviolet rays excite phosphors in vacuum, thereby creating gas discharge in discharge cells. PDPs are the next-generation thin-film display devices and can be manufactured with large high-resolution screens.

PDPs display letters or graphics using the light emitted from the plasma generated upon discharging the gas. That is, plasma is discharged to generate ultraviolet rays upon application of voltage to two electrodes mounted within the discharge space of the plasma display panel. The ultraviolet rays then excite the patterned phosphor layers to display a certain image.

Plasma display panels are generally classified into three types: an alternating current type (AC type), a direct current type (DC type), and a hybrid type. The hybrid type is most popular. FIG. 7 is a partial perspective view of a discharge cell of a conventional alternating current plasma display panel. As shown in FIG. 7, a conventional plasma display panel 100 comprises a first substrate 111, a plurality of address electrodes 115 formed on the first substrate 111, a dielectric layer 119 formed on the first substrate 111 over the address electrodes 115, a plurality of barrier ribs 123 formed on the dielectric layer 119 to maintain discharge distance and to prevent cross talk between cells, and phosphor layers 125 formed on the surface of the barrier ribs 123.

A plurality of discharge sustain electrodes 117 are formed on the second substrate 113, are positioned facing the first substrate 111, and are spaced apart from the address electrodes 115 formed on the first substrate 111. A dielectric layer 121 is positioned on the discharge sustain electrodes 117, and a protection layer 127 is positioned on the dielectric layer. The protection layer 127 mainly comprises MgO because MgO is transparent enough to transmit visible rays and effectively protects the dielectric layer and emits secondary electrons. Recently, it has been suggested to include additional materials in the protection layer.

The MgO protection layer is a transparent thin film having a sputtering-resistant characteristic. The protection layer absorbs ion collisions produced by the discharge gas upon discharge during driving of the plasma display panel, thereby protecting the dielectric layer from ion collisions and decreasing the discharge voltage by emitting secondary electrons. The protection layer is generally formed on the dielectric layer and generally ranges in thickness from about 5000 Å to about 9000 Å. The MgO protection layer may be formed by sputtering, electron beam deposition, ion beam assisted deposition (IBAD), chemical vapor deposition (CVD), sol-gel methods and so on. Recently, ion plating has been developed and used to form MgO protection layers.

Electron beam deposition provides a MgO protection layer by accelerating an electron beam with electric and magnetic fields and colliding that electron beam with the MgO deposition material. The deposition material is then heated and evaporated. Sputtering provides a denser protection layer with improved crystal alignment, but involves increased production cost. In sol-gel methods, the MgO protection layer is formed as a liquid.

Ion plating has recently been suggested as an alternative to form a variety of MgO protection layers. In this method, the evaporated particles are ionized and form a target. Ion plating has characteristics similar to those of sputtering, namely adhesion and crystallinity of the MgO protection layer, but can be carried out at high speeds, for example 8 nm/s.

SUMMARY OF THE INVENTION

The present invention is directed to a plasma display panel ("PDP") comprising a MgO protection layer having a controlled surface roughness within a specified range. Such a PDP exhibits improved electron emission and decreased discharge initiation voltage and discharge sustain voltage, as well as improved sputtering-resistance and display quality.

The present invention is also directed to a plasma display panel comprising a MgO protection layer having controlled surface roughness. Such a PDP exhibits improved display quality and controls the inability of certain cells to discharge due to their inability to light.

In one embodiment, the present invention provides a plasma display panel comprising first and second substrate substrates positioned substantially parallel to each other, facing each other and separated from each other by a predetermined distance. A plurality of address electrodes are positioned on the first substrate. A first dielectric layer covers the plurality of address electrodes on the first substrate. A plurality of barrier ribs having predetermined heights are positioned on the first dielectric layer, providing discharge spaces between the first and second substrates. Phosphor layers are positioned within the discharge spaces. A plurality of discharge sustain electrodes are positioned on the surface of the second substrate facing the first substrate, and are positioned perpendicular to the address electrodes. A second dielectric layer is positioned on the second substrate covering the discharge sustain electrodes. A MgO protection layer having a surface roughness (Rms) of about 60 to about 250 Å is positioned over the second dielectric layer.

BRIEF DESCRIPTION OF THE DRAWINGS

The patent of application file contains at least one drawing executed in color. Copies of this patent or patent application publication with color drawing(s) will be provided by the Office upon request and payment of the necessary fee.

The accompanying drawings, which are incorporated in and constitute a part of the specification, illustrate exemplary embodiments of the invention, and, together with the description, serve to explain the principles of the invention.

DETAILED DESCRIPTION

Figure 1:
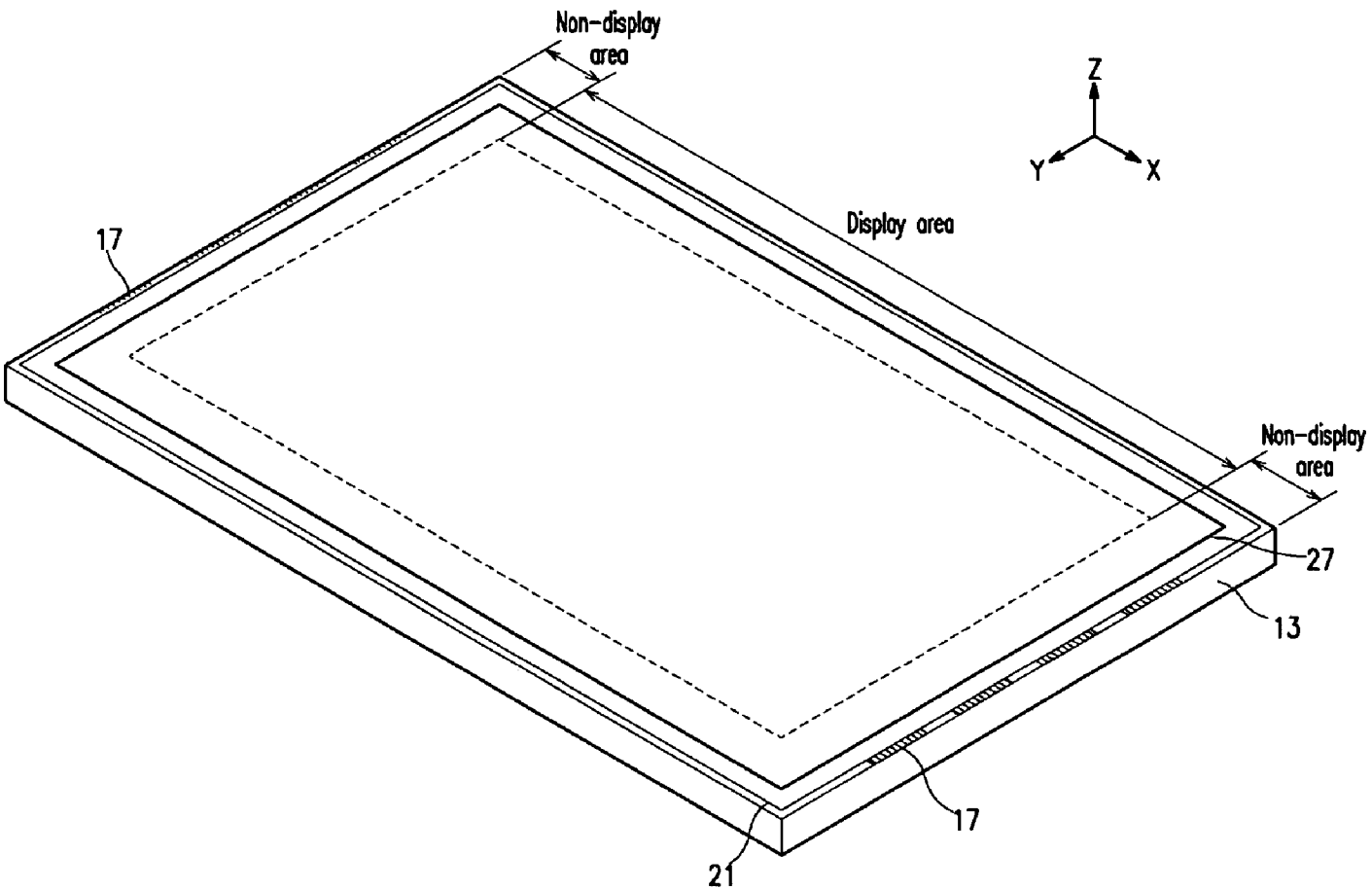
FIG. 1 is a perspective view of a second substrate of a plasma display panel according to one embodiment of the present invention.

Exemplary embodiments of the present invention will be described in further detail with reference to the accompanying drawings. The drawings and description are provided for purposes of illustration, and the invention is not limited thereto.

In one embodiment of the present invention, a plasma display panel comprises a MgO protection layer having a controlled surface roughness within a predetermined range. The MgO protection layer is manufactured with a crystalline column structure by heat deposition. Such a PDP exhibits improved display quality.

By increasing the surface roughness of the protection layer, the specific surface area also increases, thereby improving electron emission. Protection layers having high electron emission and good sputtering resistance have been suggested to improve display quality and increased stability of plasma display panels. Accordingly, in one embodiment of the present invention, a plasma display panel comprises a protection layer having a surface roughness within a specified range. This protection layer maintains sputtering resistance and improves electron emission.

When compared to a protection layer according to the prior art, an MgO protection layer according to one embodiment of the present invention having a surface roughness between 60 and 250 Å exhibited improved electron emission and improved sputtering resistance. Preferably, however, the surface roughness (Rms) of ranges from about 150 to about 200 Å.

When the surface roughness of the MgO protection layer having a crystalline column structure is within the above range, the specific surface area of the MgO protection layer is increased, electron emission is improved, discharge initiation voltage is decreased and discharge sustain voltage is decreased. However, when the surface roughness is excessively increased, i.e. to over about 250 Å, electric current becomes locally concentrated, thereby locally damaging the protection layer by increasing sputtering in certain areas, resulting in decreased life of the layer.

The MgO protection layer is a thin film that emits electrons and is produced by heat deposition. According to one embodiment of the present invention, the MgO protection layer may be formed by any heat deposition method including those selected from the group consisting of electron beam deposition (EB), ion plating, sputtering, ion beam assisted deposition (IBAD), and chemical vapor deposition (CVD). Preferably, the protection layer is formed by ion plating.

According to one embodiment of the present invention, the surface roughness is controlled within the above range by controlling reaction conditions such as temperature, reaction rate, gas partial pressure, and so on. The temperature for controlling surface roughness preferably ranges from about 200 to about 350° C., and more preferably from about 250 to about 300° C. The reaction rate depends on the conditions under which the MgO protection layer is formed, which are not limited. The gas partial pressure, for example the hydrogen partial pressure, preferably ranges from about $8\times10^{-7}$ to about $3\times10^{-6}$ torr, and more preferably from about $1\times10^{-6}$ to about $2\times10^{-6}$ torr.

The thickness of the MgO protection layer ranges from about 500 nm and about 9000 nm. The transmissivity of the MgO protection layer is preferably about 90% or more, and the refractive index preferably ranges from about 1.45 to about 1.74 at about 640 nm.

The MgO protection layer of the present invention is a grown film having a mixed crystalline orientation. The surface grain size of the protection layer preferably ranges from about 70 to about 350 nm.

Hereinafter, plasma display panels comprising protection layers according to exemplary embodiments of the present invention will be described in detail with reference to the accompanying drawings.

FIG. 1 depicts a second substrate of a plasma display panel comprising a protection layer according to one embodiment of the present invention. FIG. 1 shows the surface of the second substrate 13 that faces the first substrate 11. As shown in FIG. 1, a plurality of discharge sustain electrodes 17 are positioned on the second substrate 13. A second dielectric layer 21 is positioned over the discharge sustain electrodes 17, and a protective layer 27 having a surface roughness (Rms) ranging from about 60 to about 250 Å is positioned on the second dielectric layer 21. For helping comprehension, the upper substrate of the plasma display panel according to the present invention is reversed by 180 degree.

Figure 1A:
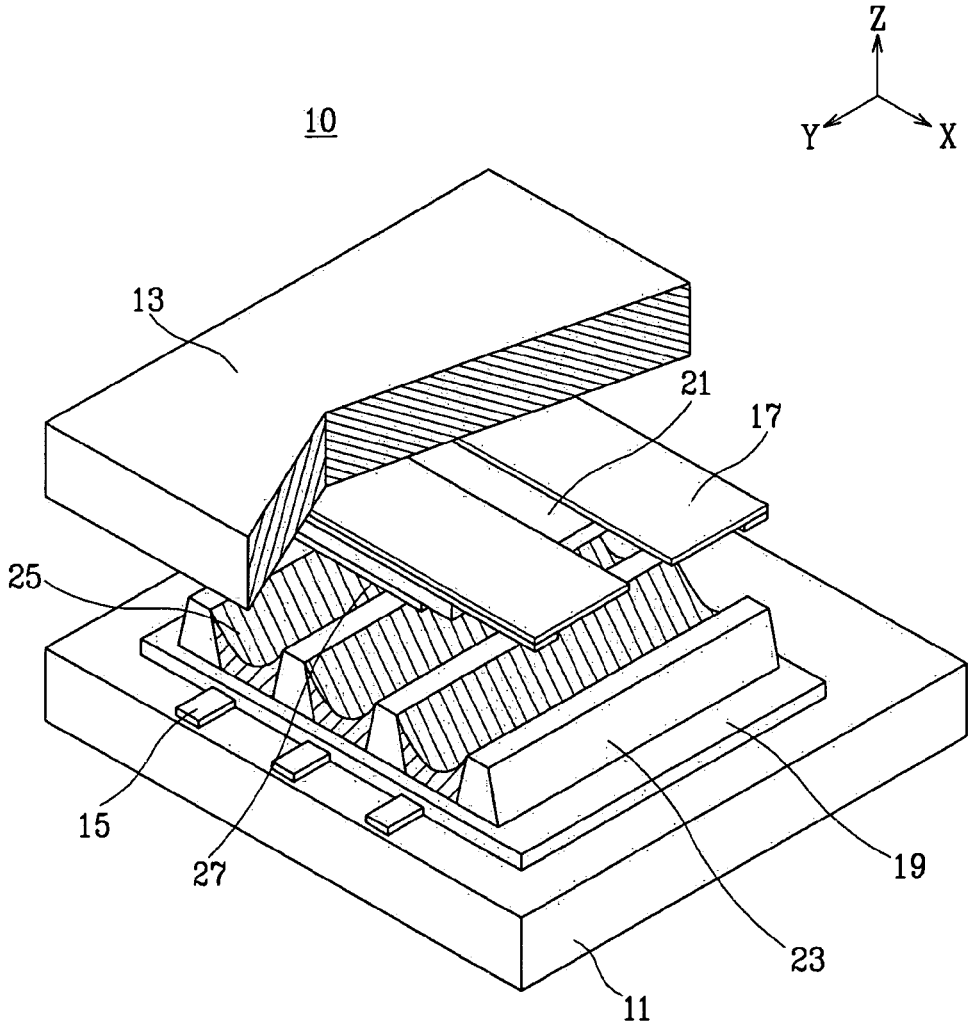
FIG. 1*a* is a partial perspective view of a plasma display panel according to one embodiment of the present invention.

FIG. 1*a* is a partial perspective view of a plasma display panel 10 including the second substrate of FIG. 1. As shown in FIG. 1*a*, a plurality of address electrodes 15 are positioned on a first substrate 11 facing the second substrate 13. The address electrodes 15 are positioned perpendicular to the discharge sustain electrodes 17 on the second substrate 13. A first dielectric layer 19 covers the address electrodes 15. Barrier ribs 23 are positioned on the first dielectric layer 19. Phosphor layers 25 are coated between the barrier ribs 23, thereby forming the first substrate 11 of a plasma display panel.

Therefore, a plasma display panel according to one embodiment of the present invention comprises first and second substrates 11 and 13, respectively, positioned substantially parallel to each other, facing each other and separated from each other by a predetermined distance.

Address electrodes 15 are positioned on the surface of the first substrate 11 facing the second substrate 13, and are positioned substantially perpendicular to the discharge sustain electrodes 17 positioned on the surface of the second substrate 13 facing the first substrate 11. A first dielectric layer 19 covers the plurality of address electrodes 15. A plurality of barrier ribs 23 having predetermined heights are mounted on the first substrate 11 and extend into the space between the first and second substrates 11 and 13, respectively. The barrier ribs 23 are separated from each other by predetermined intervals, creating discharge spaces between the ribs. Phosphor layers 25 are positioned in the discharge spaces on the first dielectric layer 19 and on the sides of the barrier ribs 23.

A plurality of discharge sustain electrodes 17 are positioned on the surface of the second substrate 13 facing the first substrate 11. The discharge sustain electrodes 17 are positioned substantially perpendicular to the address electrodes 15 on the first substrate 11. A second dielectric layer 21 covers the discharge sustain electrodes 17. A MgO protection layer covers the second dielectric layer 21 and has a surface roughness (Rms) ranging from about 60 to about 250 Å.

The edges of the upper substrate and the lower substrate of the resultant plasma display panel are coated with frit to seal the substrates. The construction is then injected with either Ne or Xe discharge gas to form a plasma display panel.

In a plasma display panel according to one embodiment of the present invention, a driving voltage is applied to the address electrodes, thereby generating an address discharge between the address electrodes and forming a wall current in the first dielectric layer. After address discharge, current is alternatingly fed to the discharge sustain electrodes, thereby created sustain discharge between the discharge sustain electrodes. Consequently, the discharge gas within the discharge spaces of the discharge cells is excited and shifted, thereby generating ultraviolet rays. These ultraviolet rays excite the phosphors, thereby generating visible rays, and displaying the desired images.

As shown in FIG. 1, pixels, i.e. areas where a plurality of electrodes intersect, are formed within the area covered by the protective layer. The pixels form a display area. Areas outside the display area are non-display areas. The terminal parts of the discharge sustain electrodes 17 on the second substrate 13 are shown to the right and left of the protective layer 27 and contact a flexible printed circuit (FPC) (not shown).

The plasma display panels of the present invention may be fabricated by any known method. Methods of fabricating plasma display panels are well known to those skilled in the art. However, the process for forming the MgO protection layer will be described below.

The protection layer covers the second dielectric layer of the plasma display panel to protect the dielectric layer from ion collisions of the discharge gas during discharge. As described above, the protection layer comprises MgO, is sputtering resistant and has a high secondary electron emission coefficient. The MgO material of the protection layer may be a single crystal material or a sintered material. Preferably, the MgO protection layer is formed by ion plating and adding the certain dopant in a fixed quantity upon forming the sinter MgO material.

The deposition material of the MgO protection layer is formed by shaping the material into pellets and sintering the pellets. The size and shape of the pellets are preferably optimized because the decomposition rate of the pellets depends on the size and shape of the pellets, and because the size and shape of the pellets affects the deposition rate of the protection layer.

Further, the composition of the protection layer and the characteristics of the layer remarkably improve discharge characteristics because the MgO protection layer contacts the discharge gas. The characteristics of the MgO protection layer substantially depend on the composition of the layer and the coating conditions during deposition. Accordingly, optimal compositions suitable for improving the layer characteristics are preferably used.

The MgO protection layers according to the present invention are formed by heat deposition such as sputtering, electron beam deposition, ion beam assisted deposition (IBAD), chemical vapor deposition (CVD), plasma enhanced chemical vapor deposition (PECVD), plasma vapor deposition (PVD), vacuum deposition, vacuum thermal deposition) and so on. Preferably, however, the layers are formed by ion plating and have surface roughnesses ranging from about 60 to about 250 Å.

The following examples illustrate the present invention in further detail. However, it is understood that the present invention is not limited by these examples.

EXAMPLE 1

Discharge sustain electrodes comprising indium tin oxide conductive materials were positioned on a second substrate in a striped pattern. The second substrate comprised soda lime glass.

Then, a lead-based glass paste was coated on the second substrate over the discharge sustain electrodes and sintered to form a second dielectric layer.

A MgO protection layer having a surface roughness (Rms) of 60 Å was ion plated to the second dielectric layer, thereby forming a second substrate. The surface roughness was controlled by varying the temperature, reaction rate, and gas partial pressure, and was analyzed by atomic force microscopy (AFM).

EXAMPLE 2

A second substrate was fabricated as in Example 1, except that the surface roughness (Rms) of the MgO protection layer was 88 Å.

EXAMPLE 3

A second substrate was fabricated as in Example 1, except that the surface roughness (Rms) of the MgO protection layer was 150 Å.

EXAMPLE 4

A second substrate was fabricated as in Example 1, except that the surface roughness (Rms) of the MgO protection layer was 185 Å.

EXAMPLE 5

A second substrate was fabricated as in Example 1, except that the surface roughness (Rms) of the MgO protection layer was 200 Å.

EXAMPLE 6

A second substrate was fabricated as in Example 1, except that the surface roughness (Rms) of the MgO protection layer was 250 Å.

EXAMPLE 7

A second substrate was fabricated as in Example 1, except that the surface roughness (Rms) of the MgO protection layer was 186 Å.

COMPARATIVE EXAMPLE 1

A MgO protection layer was fabricated by conventional deposition without controlling the surface roughness. The layer has a thickness of 600 nm and a surface roughness (Rms) of 20 Å. This protection layer prolonged the discharge delay and decreased the display quality of the high definition PDP.

COMPARATIVE EXAMPLE 2

A MgO protection layer was fabricated as in Comparative Example 1, except that the surface roughness (Rms) was 50 Å, and was controlled. This protection layer prolonged the discharge delay and decreased the display quality of the PDP.

COMPARATIVE EXAMPLE 3

A MgO protection layer was fabricated as in Comparative Example 1, except that the surface roughness (Rms) was 55 Å, and was controlled. This protection layer prolonged the discharge delay and decreased the display quality of the PDP.

COMPARATIVE EXAMPLE 4

A MgO protection layer was fabricated as in Comparative Example 1, except that the surface roughness (Rms) was 265 Å, and was controlled. This protection layer prolonged the discharge delay and decreased the display quality of the PDP.

COMPARATIVE EXAMPLE 5

A MgO protection layer was fabricated as in Comparative Example 1, except that the surface roughness (Rms) was 280 Å, and was controlled. This protection layer prolonged the discharge delay and decreased the display quality of the PDP.

COMPARATIVE EXAMPLE 6

A MgO protection layer was fabricated as in Comparative Example 1, except that the thickness was 700 nm and the surface thickness (Rms) was 300 Å, and was controlled. This protection layer prolonged the discharge delay and decreased the display quality of the PDP.

Testing Method 1

Figure 2A:
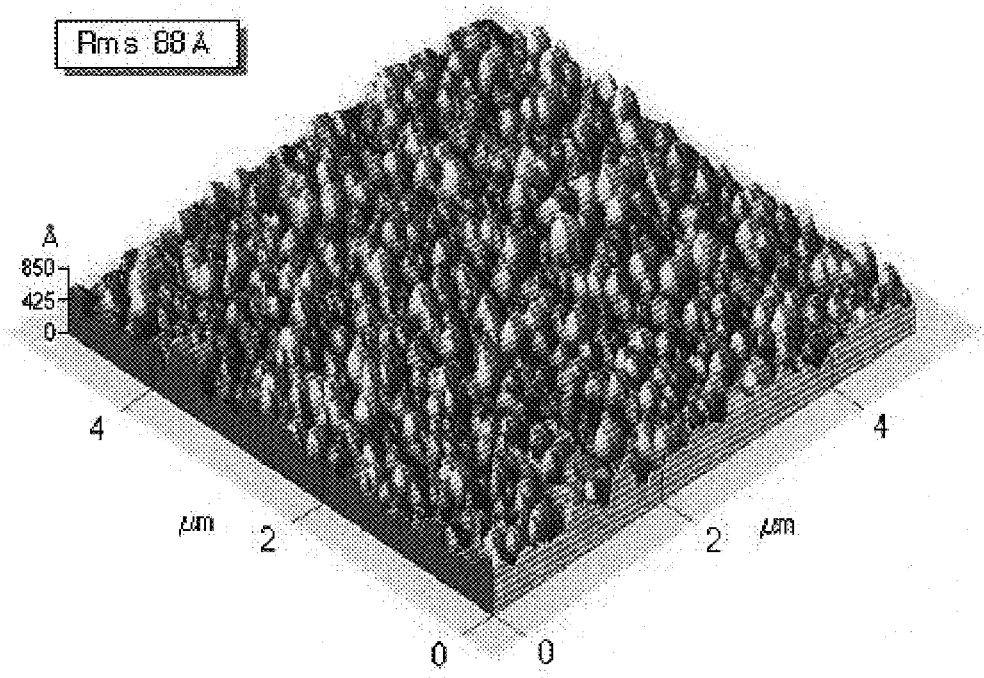
FIG. 2*a* is a scanning electron microscope ("SEM") photograph of a surface of a MgO protection layer prepared according to Example 2.
Figure 2B:
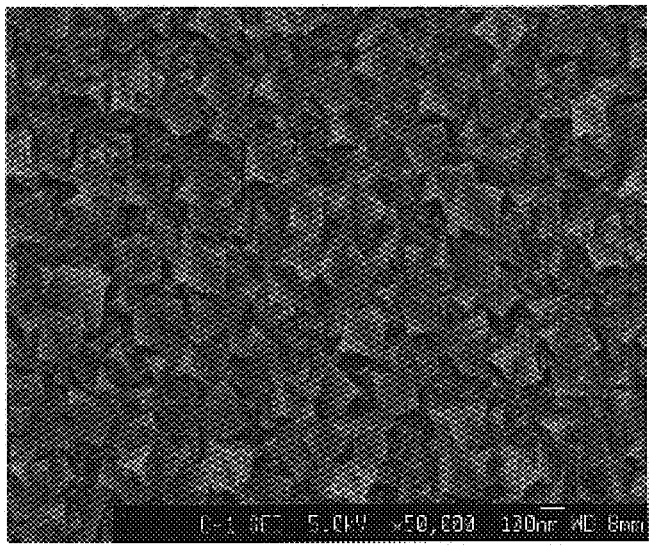
FIG. 2*b* is a perspective view of an SEM photograph of a surface of a MgO protection layer prepared according to Example 2.
Figure 2C:
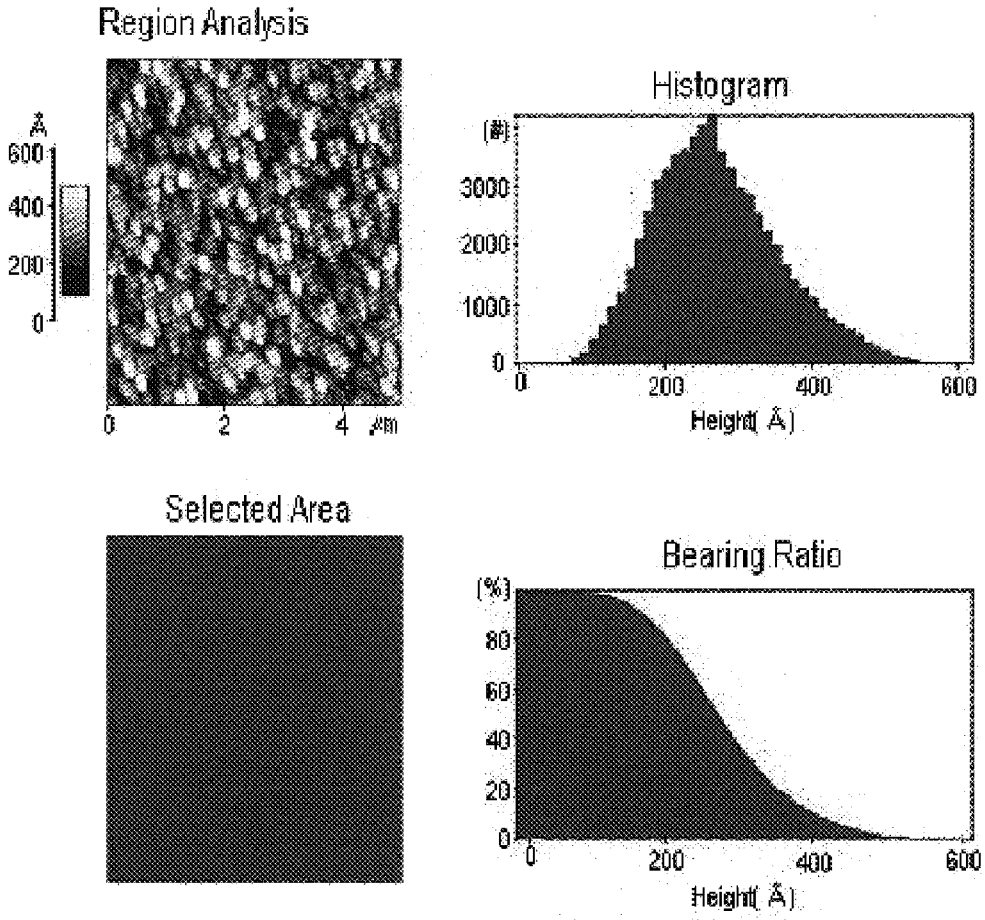
FIG. 2*c* is a collection of area analysis results of the surface roughness of a MgO protection layer of a plasma display panel according to Example 2.
Figure 3A:
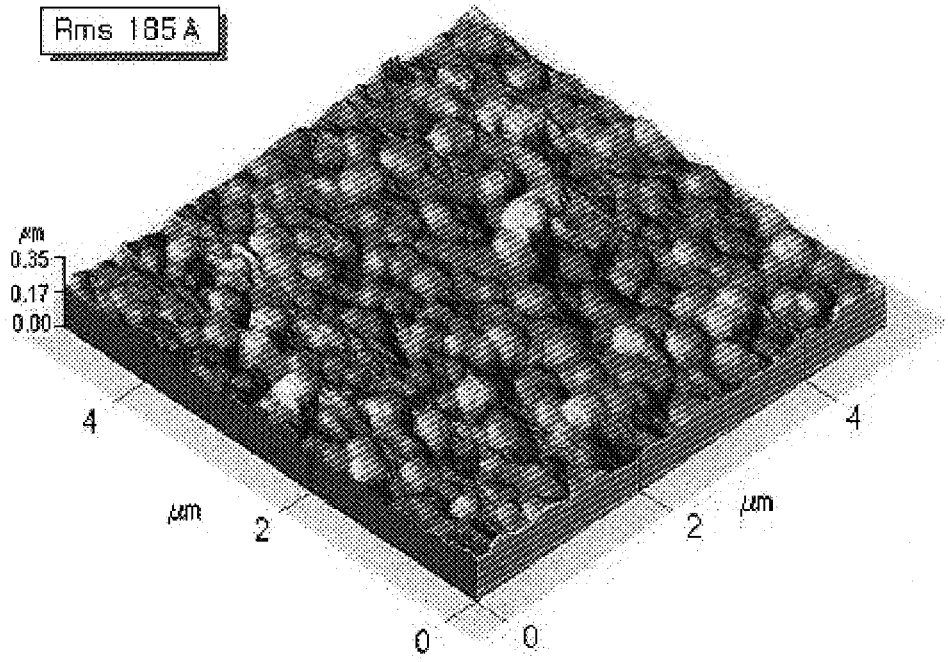
FIG. 3*a* is a scanning electron microscope ("SEM") photograph of a surface of a MgO protection layer prepared according to Example 4.
Figure 3B:
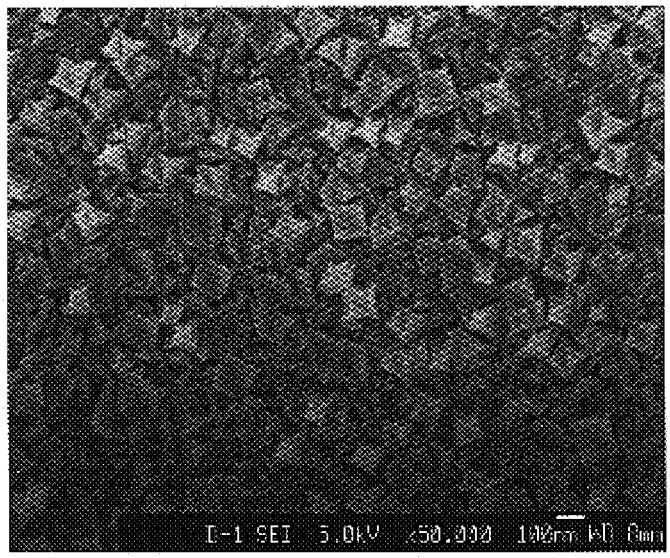
FIG. 3*b* is a perspective view of an SEM photograph of a surface of a MgO protection layer prepared according to Example 4.
Figure 3C:
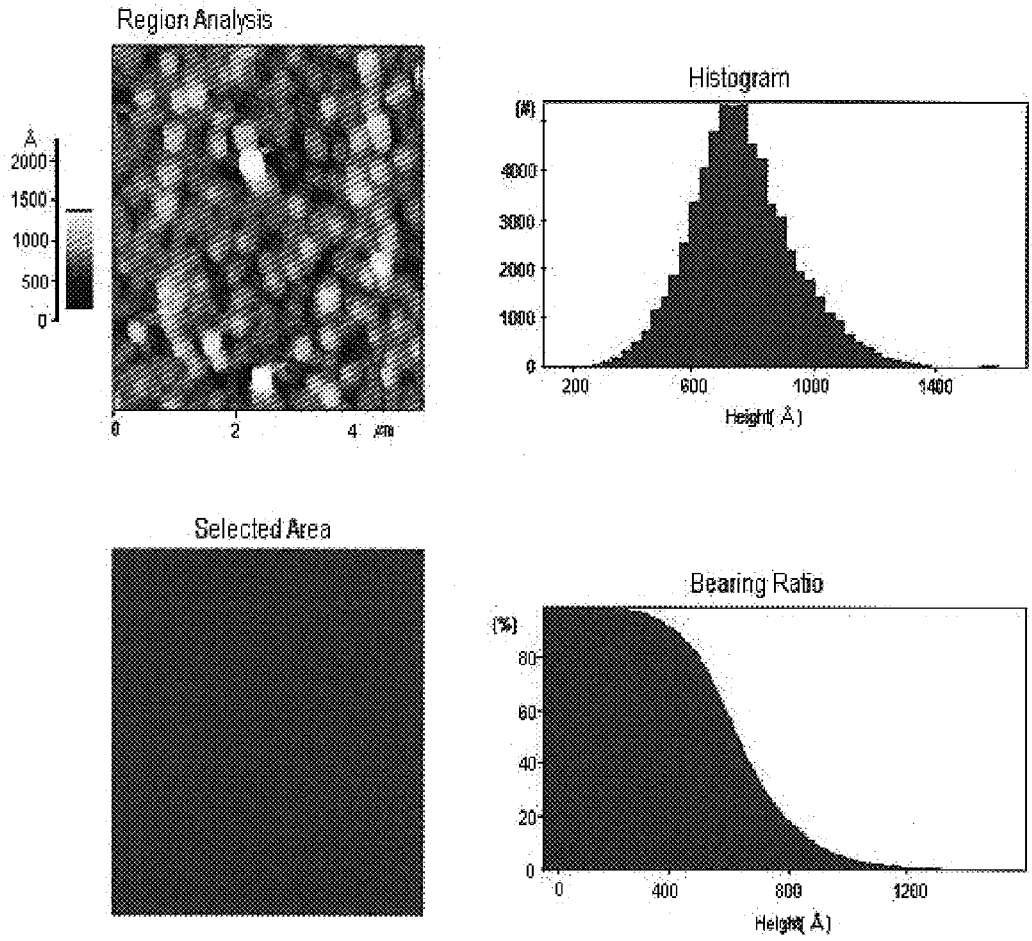
FIG. 3*c* is a collection of area analysis results of the surface roughness of a MgO protection layer of a plasma display panel according to Example 4.
Figure 4A:
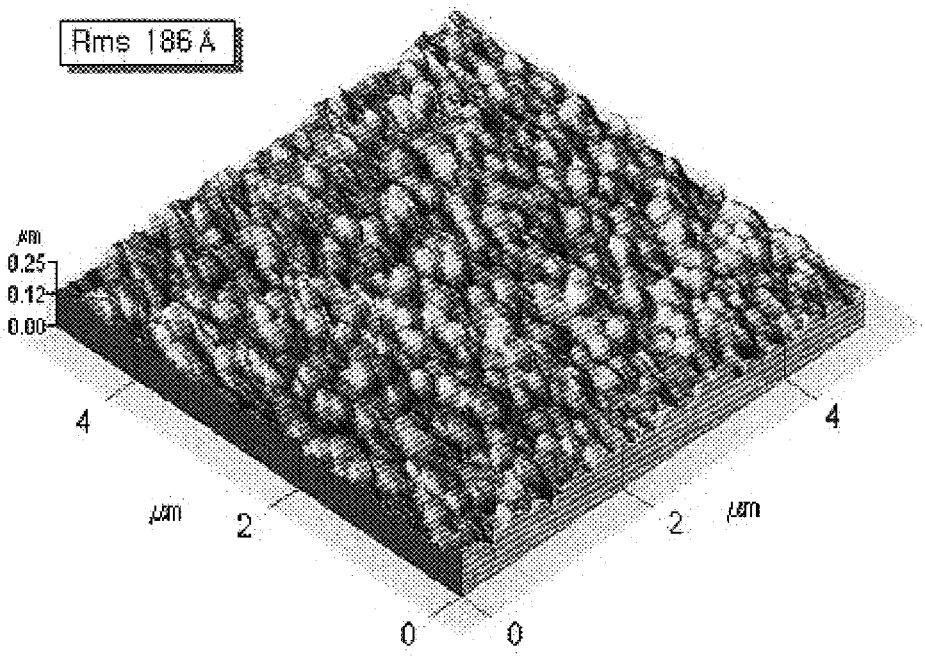
FIG. 4*a* is a scanning electron microscope ("SEM") photograph of a surface of a MgO protection layer prepared according to Example 7.
Figure 4B:
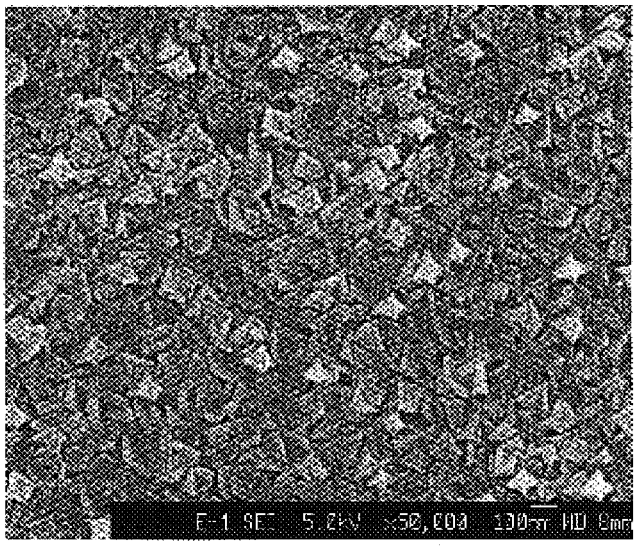
FIG. 4*b* is a perspective view of an SEM photograph of a surface of a MgO protection layer prepared according to Example 7.
Figure 4C:
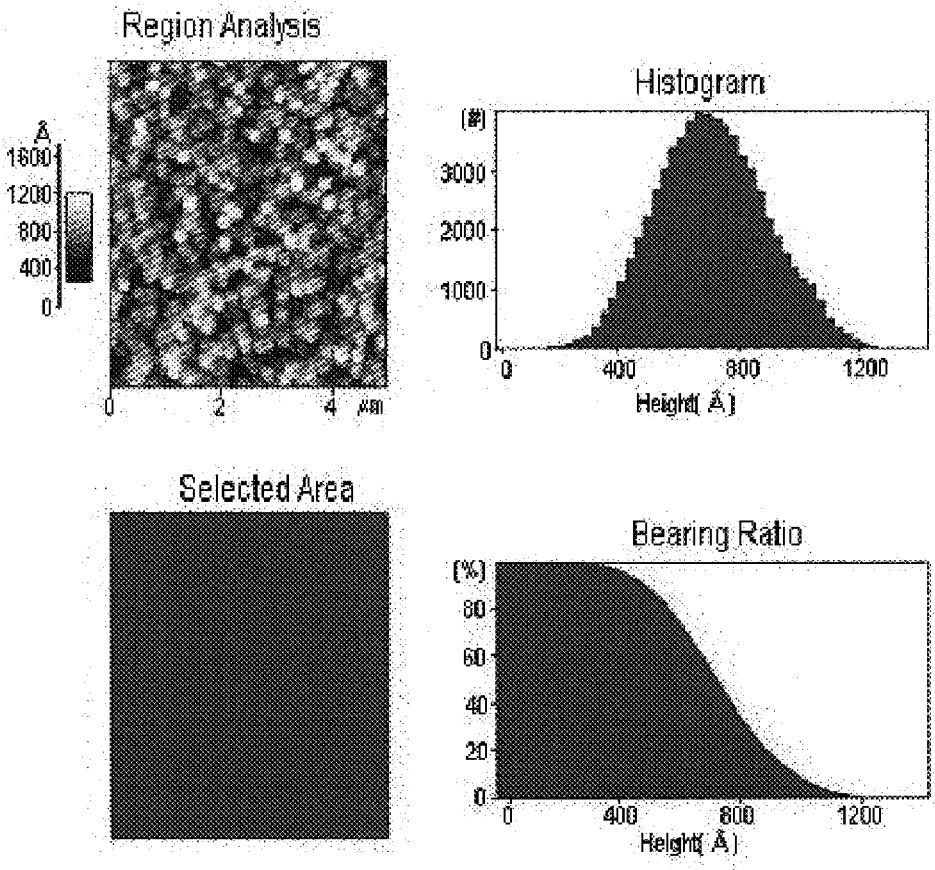
FIG. 4*c* is a collection of area analysis results of the surface roughness of a MgO protection layer of a plasma display panel according to Example 7.

Scanning electron microscope (SEM) photographs were taken of the MgO protection layers fabricated according to Examples 2, 4, and 7, and are shown in FIGS. 2*a*, 3*a* and 4*a*, respectively. FIGS. 2*b*, 3*b* and 4*b* are perspective views of SEM photographs showing the surface roughnesses of protection layers fabricated according to Examples 2, 4 and 7, respectively. FIGS. 2*c*, 3*c*, and 4*c* are collections of area analysis results for the protection layers fabricated according to Examples 2, 4 and 7, respectively.

Testing Method 2

Figure 5:
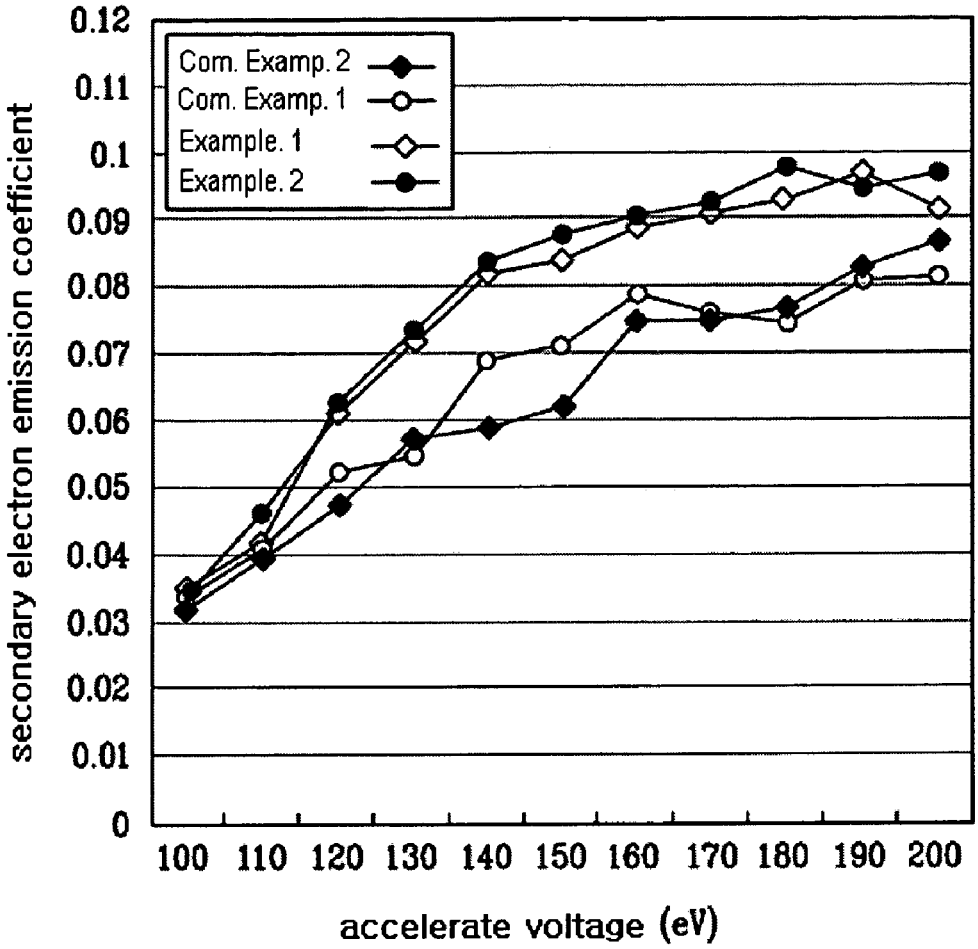
FIG. 5 is a graph comparing the sputtering resistance properties of MgO protection layers prepared according to Examples 1 and 2 and Comparative Examples 1 and 2.

FIG. 5 compares electron emission (discharge) and sputtering resistance of the protection layers fabricated according to Examples 1 and 2 and Comparative Examples 1 and 2. As shown in FIG. 5, the MgO protection layers fabricated according to Examples 1 and 2, having controlled surface roughnesses, exhibited improved secondary electron emission when compared to the layers fabricated according to Comparative Examples 1 and 2.

Testing Method 3

The gamma coefficients at 150 eV (accelerative voltage) of Examples 1 to 6 were compared to those of Comparative Examples 2 to 6. The relationship of the gamma coefficient (secondary electron emission coefficient) to the surface roughness at the accelerative voltage is shown in FIG. 6 and in Table 1 below.

TABLE 1

| | Rms (Å) | 150 eV |
|---|---|---|
| Example 1 | 60 | 0.073 |
| Example 2 | 88 | 0.084 |
| Example 3 | 150 | 0.087 |
| Example 4 | 185 | 0.088 |
| Example 5 | 200 | 0.086 |
| Example 6 | 250 | 0.071 |
| Comparative Example 2 | 50 | 0.059 |
| Comparative Example 3 | 55 | 0.061 |
| Comparative Example 4 | 265 | 0.064 |
| Comparative Example 5 | 280 | 0.062 |
| Comparative Example 6 | 300 | 0.063 |

Figure 6:
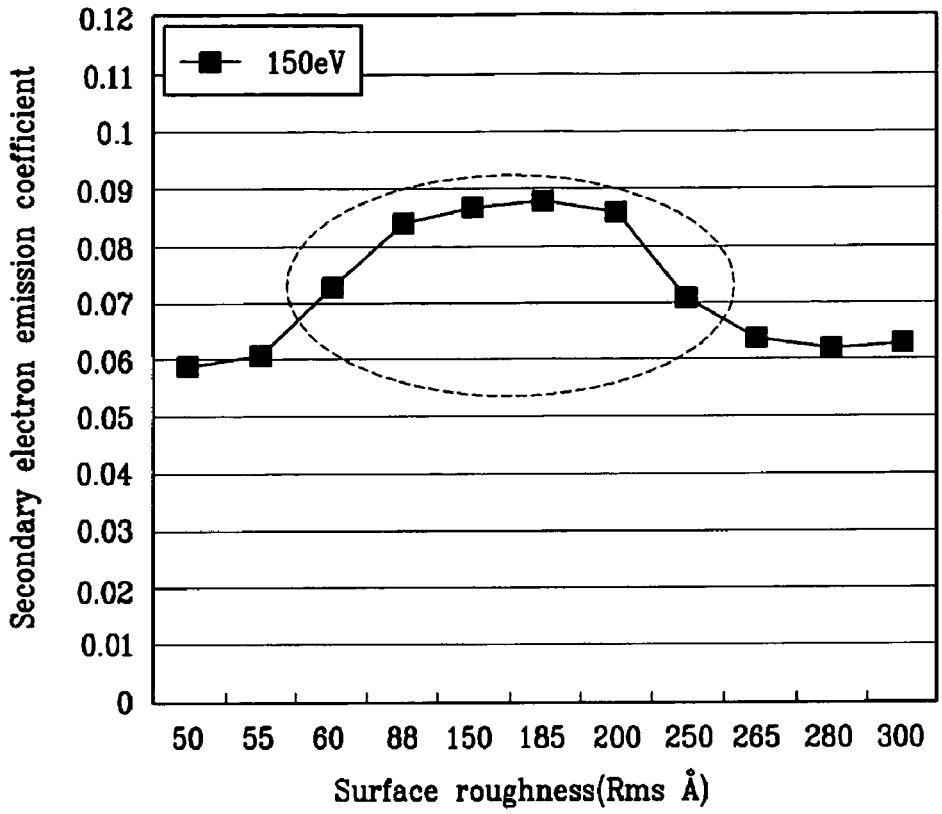
FIG. 6 is a graph representation of the relationship of the gamma coefficient (secondary electron emission coefficient) to the surface roughness (Rms) measured at the accelerative voltage (150 eV).
Figure 7:
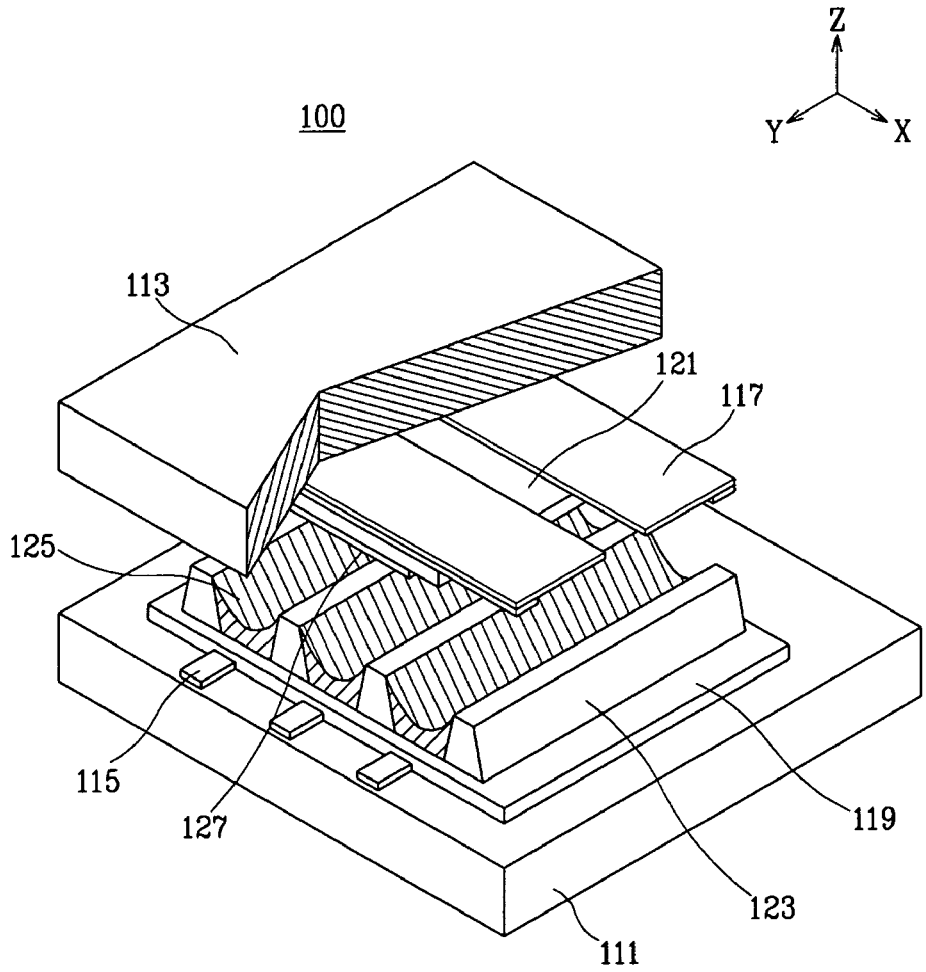
FIG. 7 (Prior Art)
FIG. 7 is a partial perspective view of an alternating current plasma display panel according to the prior art.

As shown in Table 1 and FIG. 6, the gamma coefficients of Examples 1 to 6 are remarkably superior to those of Comparative Examples 1 to 6. As shown, the best results are obtained when the surface roughness is between 150 Å and 200 Å.

As shown above, a plasma display panel according to one embodiment of the present invention comprises a MgO protection layer having a controlled surface roughness within a specified range. This protection layer has good sputtering resistance and improved electron emission and display quality.

While the present invention has been described in detail with reference to exemplary embodiments, those skilled in the art will appreciate that various modifications and substitutions can be made thereto without departing from the spirit and scope of the present invention as set forth in the appended claims.

What is claimed is:

1. A plasma display panel comprising:

first and second substrates positioned substantially parallel to each other, facing each other and separated from each other by a predetermined distance;

a plurality of address electrodes formed on the first substrate;

a first dielectric layer covering the plurality of address electrodes;

a plurality of barrier ribs mounted on the first dielectric layer, providing discharge spaces between the first and second substrates;

a plurality of phosphor layers formed within the discharge spaces;

a plurality of discharge sustain electrodes positioned on the second substrate;

a second dielectric layer covering the discharge sustain electrodes; and a MgO protection layer having a surface roughness (Rms) ranging from about 60 to about 250 Å, and a surface grain size ranging from about 70 to about 350 nm.

2. The plasma display panel according to claim 1, wherein the MgO protection layer has a transmissivity of about 90% or more and a reflective index ranging from about 1.45 to about 1.74 at about 640 nm.

3. A plasma display panel comprising:

first and second substrates positioned substantially parallel to each other, facing each other and separated from each other by a predeteremined distance;

a plurality of address electrodes formed on the first substrate;

a first dielectric layer covering the plurality of address electrodes;

a plurality of barrier ribs mounted on the first dielectric layer, providing discharge spaces between the first and second substrates;

a plurality of phosphor layers formed within the discharge spaces;

a plurality of discharge sustain electrodes positioned on the second substrate;

a second dielectric layer covering the discharge sustain electrodes; and a MgO protection layer having a surface roughness (Rms) ranging from about 60 to about 250 Å, wherein the MgO protection layer has a thickness ranging from about 500 to about 9000 nm.

4. A plasma display panel comprising:

first and second substrates positioned substantially parallel to each other, facing each other and separated from each other by a predetermined distance;

a plurality of address electrodes formed on the first substrate;

a first dielectric layer covering the plurality of address electrodes;

a plurality of barrier ribs mounted on the first dielectric layer, providing discharge spaces between the first and second substrates;

a plurality of phosphor layers formed within the discharge spaces;

a plurality of discharge sustain electrodes positioned on the second substrate;

a second dielectric layer covering the discharge sustain electrodes; and a MgO protection layer having a surface roughness (Rms) ranging from about 150 to about 200 Å.

5. The plasma display panel according to claim 4, wherein the MgO protection layer has a transmissivity of about 90% or more and a refractive index ranging from about 1.45 to about 1.74 at about 640 nm.

6. The plasma display panel according to claim 4, wherein the MgO protection layer has a surface grain size ranging from about 70 to about 350 nm.

7. The plasma display panel according to claim 4, wherein the MgO protection layer has a thickness ranging from about 500 to about 9000 nm.

* * * * *